US006478169B2

(12) United States Patent
Krusell

(10) Patent No.: US 6,478,169 B2
(45) Date of Patent: Nov. 12, 2002

(54) IN-LINE SKATE RACK AND METHOD OF USING SAME

(75) Inventor: Georgia L. Krusell, Hudson, WI (US)

(73) Assignee: Long Pond Enterprises, Inc., Hudson, WI (US)

( * ) Notice: Subject to any disclaimer, the term of this patent is extended or adjusted under 35 U.S.C. 154(b) by 0 days.

(21) Appl. No.: 09/930,089

(22) Filed: Aug. 15, 2001

(65) Prior Publication Data

US 2002/0027114 A1 Mar. 7, 2002

Related U.S. Application Data

(60) Provisional application No. 60/225,459, filed on Aug. 15, 2000.

(51) Int. Cl.[7] ..... A47F 7/00

(52) U.S. Cl. ..... 211/85.7; 211/186; 211/135; 280/79.3; D6/552

(58) Field of Search ..... 280/79.3; 211/153, 211/135, 134, 186, 13.1, 85.7, 37; 108/25, 28; D6/552

(56) References Cited

U.S. PATENT DOCUMENTS 993,491 A * 5/1911 Wiselogel
2,011,357 A * 8/1935 Ford ..... 211/153
D167,395 S * 8/1952 Dunn
2,702,127 A * 2/1955 Pastorius, III et al.
3,891,228 A * 6/1975 Rhinehart et al. ..... 280/79.3 X
3,909,718 A 9/1975 Allsop et al. ..... 224/45
4,595,107 A * 6/1986 Welsch ..... 280/79.3 X
D334,497 S * 4/1993 Putty
5,617,958 A * 4/1997 Laug et al.
5,617,983 A 4/1997 Lindauer et al. ..... 224/433
5,797,503 A * 8/1998 Stevens et al. ..... 211/186 X
6,079,572 A 6/2000 Irvin ..... 211/23
6,193,082 B1 2/2001 Bartle ..... 211/85.7

* cited by examiner

*Primary Examiner*—Robert W. Gibson, Jr.
(74) *Attorney, Agent, or Firm*—Kinney & Lange, P.A.

(57) ABSTRACT

A movable rack for storing and organizing in-line skates. The rack comprises a frame to support at least one platform containing elongated slots. The frame includes four horizontal support members to support the platform extending between four vertical members. The elongated slots contained within the platform have a suitable width to allow only a wheeled portion of the in-line skate therethrough, thus supporting the in-line skate in a substantially upright position.

5 Claims, 4 Drawing Sheets

10
32
12
20
18
16
14
22
52
35
48
42
50
44

12
20
20
32
30
22
30
16
22
30
35
22
30
18
18
14
14
14
14
16
26
34
26
34
22
35
52
35
48
46
50
44
30
30
30
30
30
20
20
28
28
18
18
10

IN-LINE SKATE RACK AND METHOD OF USING SAME

CROSS-REFERENCE TO RELATED APPLICATION(S)

Applicant claims the priority date of U.S. Provisional Application 60/225,459, filed Aug. 15, 2000.

BACKGROUND OF THE INVENTION

The present invention relates to a rack for holding skates. In particular, the present invention relates to a rack for sorting, organizing and storing in-line skates.

In-line skates have become an extremely popular form of recreational entertainment. Adults and children alike enjoy the speed, mobility and physical exercise associated with in-line skating. This being so, elementary, middle and high schools have incorporated in-line skating programs into existing physical education programs. These programs include students using in-line skates within a specified area, usually within a school gym or a school playground having a suitable surface.

In order to maximize both student participation and enjoyment of in-line skating, most schools purchase a large quantity of in-line skates to be distributed to the students during selected periods of the school day. Typically, there is only a limited amount of time that students have during the regular school day to participate in such recreational activities. It is therefore advantageous to minimize the time taken to both distribute and collect the in-line skates at the beginning and at the end of the period in order to maximize the time that students have to participate in in-line skating.

Also, children of different ages have varying sized feet, and the in-line skates must be kept together in matching pairs based on the size of the in-line skates. Additionally, the inherent bulkiness of in-line skates increases the difficulty to keep the in-line skates organized. It therefore makes it difficult to sort and organize the in-line skates when students randomly drop the in-line skates in selected areas or selected bins. This further increases the distribution time when the in-line skates are to be used again.

Furthermore, when the in-line skates are haphazardly strewn on the floor after use, damage may occur to the in-line skate, and this damage may be difficult to readily detect because it may be buried by other in-line skates thrown on top, which may also be the reason for the damage in the first place.

BRIEF SUMMARY OF THE INVENTION

The present invention includes an in-line skate rack for organizing and storing a plurality of in-line skates in an upright position. The in-line skate rack comprises a substantially rectangular horizontal support structure supported by vertical members at each comer, and at least one platform having elongated slots contained therein supported by the horizontal support structure. The elongated slots permit only a wheeled portion of the in-line skate to be insertable therethrough, thus supporting the in-line skate in a substantially upright position. Caster wheels are attachable to the in-line skate rack allowing the rack to be mobile.

DETAILED DESCRIPTION

Figure 1:
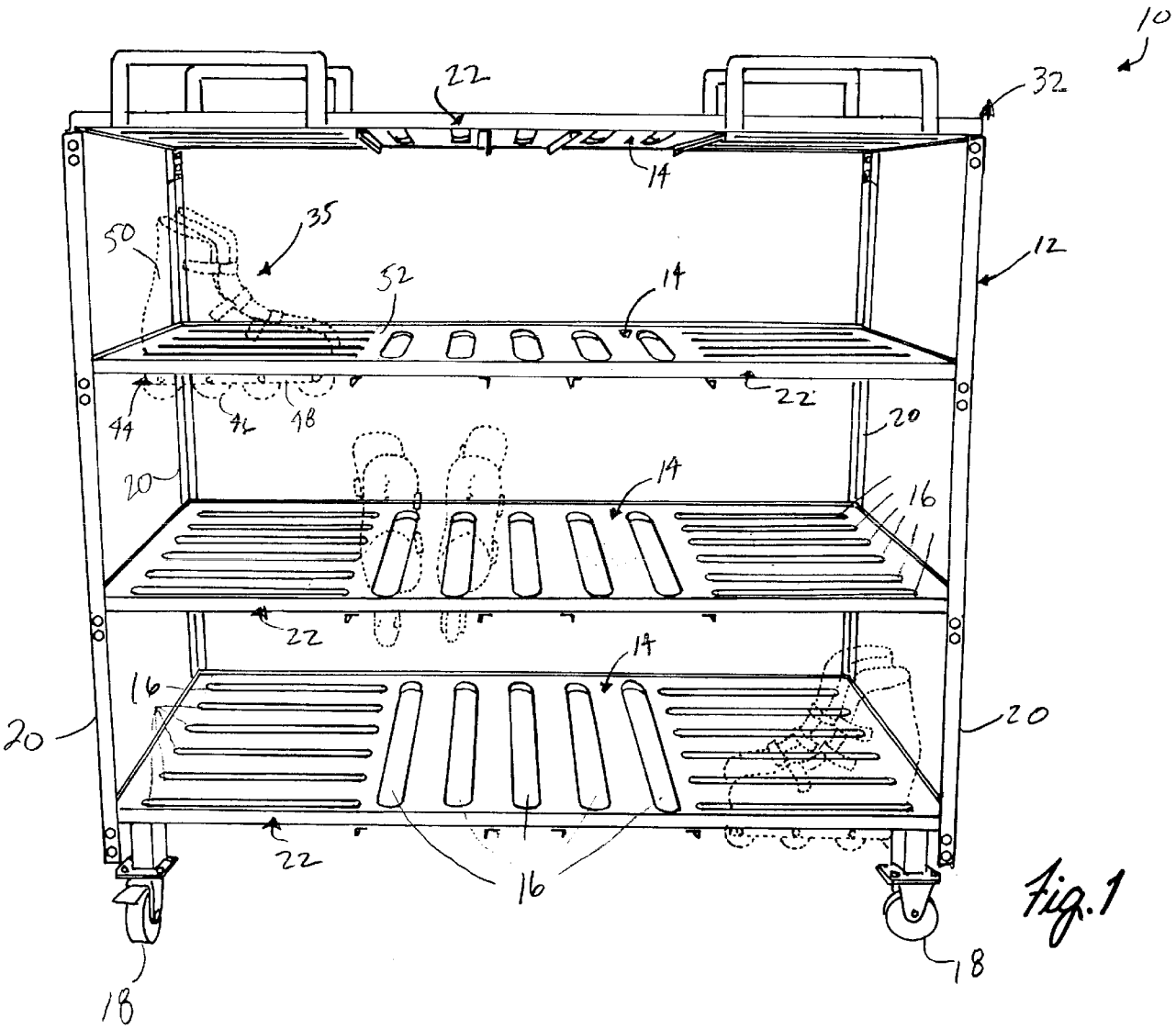
FIG. 1 is a perspective view of an in-line skate rack of the present invention.

An exemplary in-line skate rack of the present invention is indicated generally at 10 in FIG. 1. The in-line skate rack 10 of the present invention comprises a frame 12 and a platform 14, containing elongated slotted apertures 16, supported by the frame 14. Preferably, the in-line skate rack 10 of the present invention further includes caster wheels 18 attached to the frame 14 allowing the rack 10 to be transported over the ground. However, it is within the scope of the present invention to exclude the caster wheels 18, the in-line skating rack 10 thus being stationary.

Figure 2:
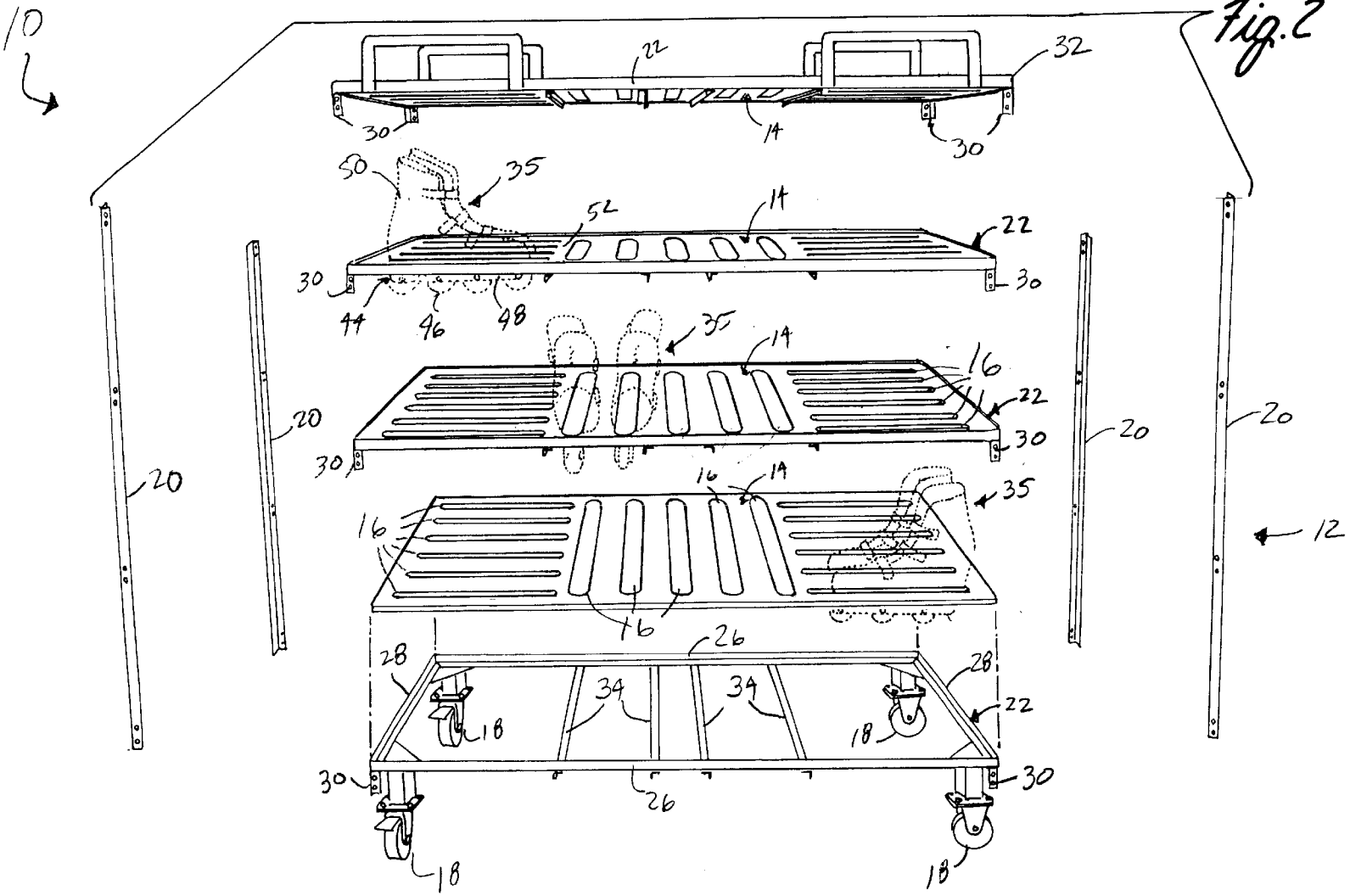
FIG. 2 is an exploded perspective view of the in-line skate rack of the present invention.
Figure 4:
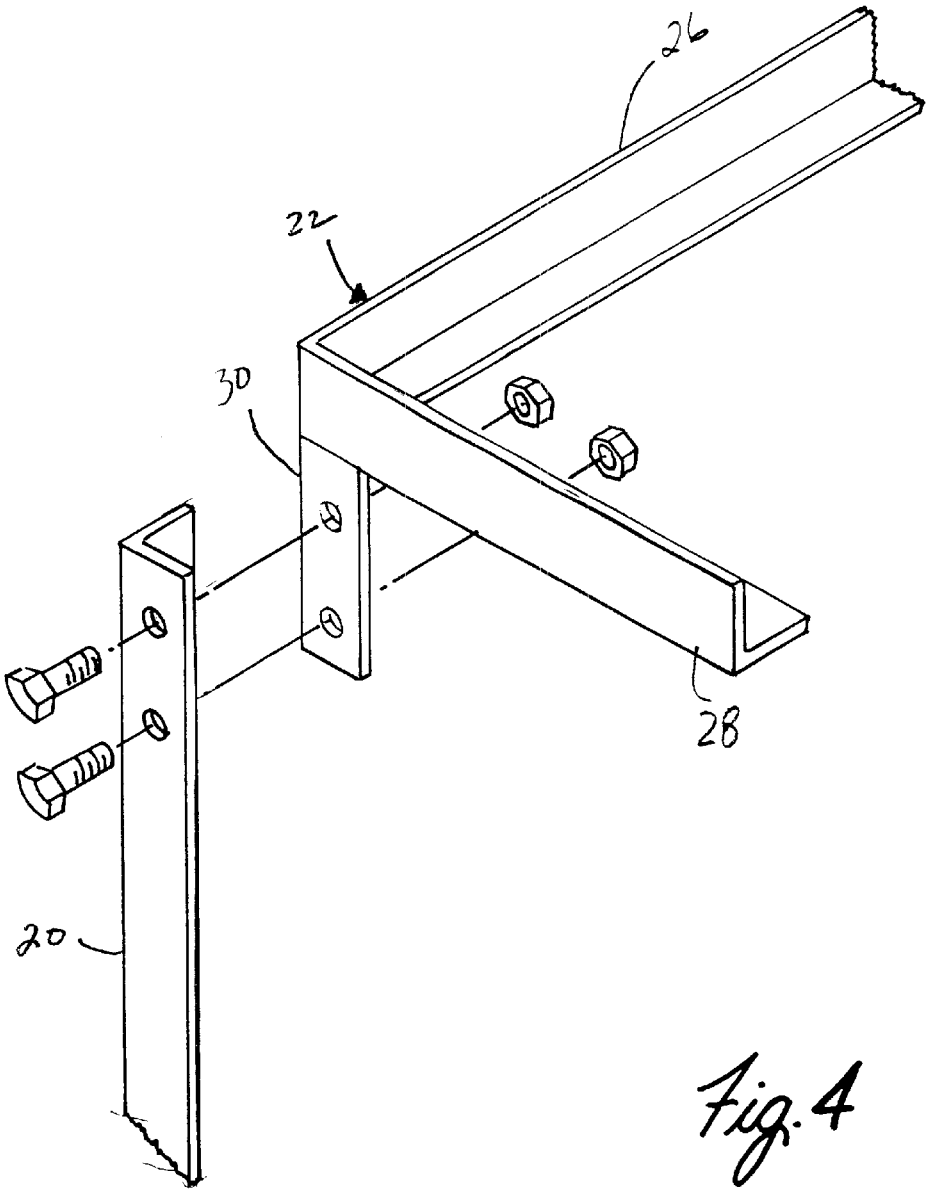
FIG. 4 is an exploded view of an attachment of a vertical member to a top horizontal support structure.

Referring to FIG. 2, the frame 14 consists of four vertical members 20 at each of four comers which support one or several horizontal support structures 22. Each horizontal support structure 22 includes horizontal members 26 and 28, extending between the four corners where each vertical member 20 is stationed. Preferably, the horizontal support structure 22 has a rectangular configuration with a suitable width to transport the in-line skate rack 10 through conventional door frames having a width of approximately 36 inches and greater. Thus, in the preferred embodiment of the present invention, each horizontal support structure 22 includes two longitudinal members 26 and two width members 28. Preferably the longitudinal and width members 26 and 28, respectively, are fixedly attached to one another. An attaching bracket 30 connected to a corner of the horizontal support structure 22 allows the horizontal support structure 22 to be attached to the vertical member 20, as illustrated in FIG. 4 as an exemplary top horizontal support structure 22 attaches to the vertical member 20.

As best illustrated in FIG. 2, the frame 12 of the in-line skate rack 10 of the present invention further includes horizontal cross-member supports 34 extending between the longitudinal members 26 of each platform support structure 22. The cross-members 34 provide further support to the platform 14.

Figure 3:
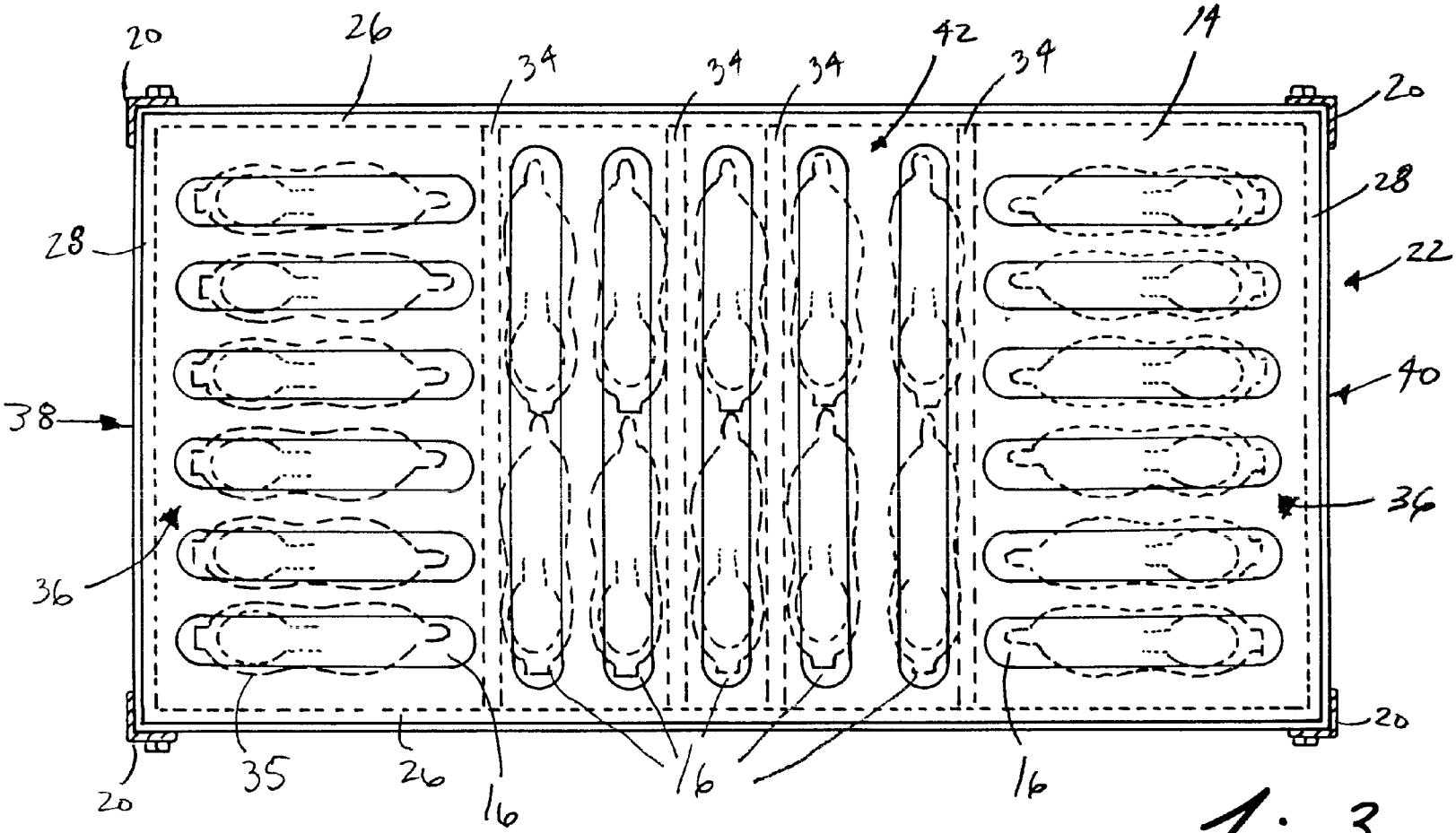
FIG. 3 is a top view illustrating a support platform of the in-line skate rack of the present invention.

Referring now to FIG. 3, the slotted platform 14 has substantially the same length and width dimensions as the horizontal support structure 22 and rests thereon. The slotted platform 14 is preferably constructed of high-density polyethylene, however it is within the scope of the present invention to construct the slotted platform 14 from other suitable materials including plywood, a similar plastic or a laminated wood material. Each slot 16 contained in the platform 14 has a general configuration of an elongated oval. The slots 16 are arranged on the platform 14 to maximize the number of in-line skates 35 each platform will hold. In the preferred embodiment of the present invention, there are two sets of longitudinal slots 36 located at proximate and distal ends 38 and 40, respectively, of the slotted platform 14. Located between the longitudinal sets 36 is a transversal set 42 of slots. The width of each slot 16 is approximately 2.25 inches, which allows only a wheel portion 44 of the in-line skate 35 to be insertable therethrough. The wheel portion 44 of the in-line skate 35 typically includes the wheels 46 and a wheel frame holder 48, as is well known in the art. With only the wheel portion 44 of the in-line skate 35 allowed to be inserted through the elongated oval slot 16, a boot portion 50 of the in-line skate 35 rests upon a top surface 52 of the platform 14. Upon insertion, the in-line skate 35 is thus held in a substantially upright position.

In the preferred embodiment of the present invention, the length of each slot 16 contained in the longitudinal set of slots 36 is suitable to accommodate a single in-line skate 35. The length of each slot 16 contained in the transversal set of slots 42 is suitable to contain up to two in-line skates 35. Using this arrangement of the longitudinal and transversal set of slots 36 and 42, 11 pairs of in-line skates may be stored on the platform 14. However, it is within the scope of the present invention to include different arrangements of the slots 16 to provide for more or less skates 35 to be handled on a platform of varying dimensions.

As illustrated in FIG. 1, the exemplary in-line skate rack 10 of the present invention includes four separate horizontal support structures 22 supporting four separate platforms 14. However, it is within the scope of the present invention to have either one, two, three, or four levels 22. Additionally, more levels 22 would also be within the scope of the present invention.

Using a physical education course as an example, a child at the beginning of class simply goes to the cart 10 and takes the appropriate sized left and right in-line skates 35 from the slots. The cart 10 may also be used to store the child's shoes while the child is skating. This reduction of time in dispersing out the in-line skates 35 increases student participation time. Also, the risk of a child tripping over items such as other in-line skates 35 on the gym floor is decreased.

At the end of the physical education class when the skates 35 are returned, unreturned skates are easily identified since the slots 16 are empty. In addition, there are no more misplaced right and left skates 35 since the skates are stored neatly side-by-side on the cart 10. The cart 10 also saves wear and tear on the in-line skates 35, and saves valuable time when doing maintenance checks on the in-line skates, since the in-line skates 35 are clearly visible in an organized fashion.

Additionally, the in-line skate rack 10 can be equipped with bumpers (not shown) for safety reasons. The bumpers are useful during transportation of the in-line skate rack 10 so that the rack does not damage doorways and walls and the like.

In an alternative embodiment of the present invention, the rack 10 may be permanently mounted to a wall.

Although the present invention has been described with reference to preferred embodiments, workers skilled in the art will recognize that changes may be made in form and detail without departing from the spirit and scope of the invention.

What is claimed is:

1. A method of organizing and storing a plurality of in-line skates, the method comprising:

pairing a left and a right in-line skate of same size;

positioning the paired in-line skates proximate one another on an in-line skate rack, the rack having a platform with a surface defining an elongated aperture allowing only a wheeled portion of either in-line skate to be insertable therethrough; and directing the rack to a selected storage area for later use, the rack having a plurality of ground engaging wheels attached thereto to assist in transporting the rack.

2. The method of claim 1 and further comprising:

retrieving the rack at a selected later time;

directing the rack to a selected location; and removing the paired in-line skates.

3. A rack for organizing and storing in-line skates, the rack comprising:

vertical comer members;

a horizontal support structure with a substantially rectangular configuration and including horizontal support members extending between two vertical comer members;

a platform supported by the horizontal support structure and vertical members, the platform having a surface defining an elongated aperture, the elongated aperture having a width sufficient to insert a wheel holder frame and wheels of the in-line skate therethrough, thus supporting the in-line skate in a substantially upright position, and a plurality of cross-members extending between two horizontal support members, the cross-members further supporting the platform.

4. The rack of claim 3 and further comprising a plurality of ground engaging wheels attachable to the frame, the ground engaging wheels allowing the rack to be mobile.

5. The rack of claim 4 wherein the width of the rack is less than 36 inches.

* * * * *

UNITED STATES PATENT AND TRADEMARK OFFICE

CERTIFICATE OF CORRECTION

PATENT NO. : 6,478,169 B2
DATED : November 12, 2002
INVENTOR(S) : Georgia L. Krusell It is certified that error appears in the above-identified patent and that said Letters Patent is hereby corrected as shown below:

Column 1,
Line 55, delete “comer”, insert -- corner --

Column 2,
Line 19, delete “comers”, insert -- corners --

Column 4,
Lines 24 and 27, delete “comer”, insert -- corner --

Signed and Sealed this

Twenty-fourth Day of June, 2003

JAMES E. ROGAN
*Director of the United States Patent and Trademark Office*